US010876438B1

(12) United States Patent
Yu et al.

(10) Patent No.: US 10,876,438 B1
(45) Date of Patent: Dec. 29, 2020

(54) BRAKING DEVICE FOR ELECTRIC ENGINE

(71) Applicant: ZHEJIANG LIMING INTELLIGENT MANUFACTURING CO., LTD., Zhoushan (CN)

(72) Inventors: Liming Yu, Zhoushan (CN); Zhenhuan Yu, Zhoushan (CN)

(73) Assignee: ZHEJIANG LIMING INTELLIGENT MANUFACTURING CO., LTD., Zhejiang (CN)

( * ) Notice: Subject to any disclaimer, the term of this patent is extended or adjusted under 35 U.S.C. 154(b) by 0 days.

(21) Appl. No.: 16/961,599

(22) PCT Filed: Aug. 29, 2019

(86) PCT No.: PCT/CN2019/103248

§ 371 (c)(1),
(2) Date: Jul. 10, 2020

(51) Int. Cl.

| | |
|---|---|
| ***F01L 1/18*** | (2006.01) |
| ***F01L 13/06*** | (2006.01) |
| ***F01L 9/04*** | (2006.01) |
| ***F01L 1/26*** | (2006.01) |
| ***F01L 1/047*** | (2006.01) |

(52) U.S. Cl.
CPC ..... *F01L 13/06* (2013.01); *F01L 1/047* (2013.01); *F01L 1/181* (2013.01); *F01L 1/26* (2013.01); *F01L 9/04* (2013.01)

(58) Field of Classification Search
CPC ... F01L 13/06; F01L 1/26; F01L 1/047; F01L 1/181; F01L 9/04
See application file for complete search history.

(56) References Cited

U.S. PATENT DOCUMENTS

| | | | | |
|---|---|---|---|---|
| 7,712,449 | B1 | 5/2010 | Schwoerer | |
| 2004/0065283 | A1 | 4/2004 | Chang | |
| 2012/0048232 | A1 | 3/2012 | Meistrick | |
| 2013/0269653 | A1 * | 10/2013 | Yang | F01L 1/20 123/323 |

FOREIGN PATENT DOCUMENTS

| | | | |
|---|---|---|---|
| CN | 101131110 | A | 2/2008 |
| CN | 101624924 | A | 1/2010 |
| CN | 102414403 | A | 4/2012 |
| CN | 102414424 | A | 4/2012 |

(Continued)

*Primary Examiner* — Zelalem Eshete
(74) *Attorney, Agent, or Firm* — Christensen, Fonder, Dardi & Herbert PLLC

(57) ABSTRACT

An electric engine braking device comprising a control mechanism and an electric driving mechanism, wherein the control mechanism comprises a housing, an execution plunger and a sliding assembly; the sliding assembly comprises a sliding block, a first elastic piece, a transfer plunger and a second elastic piece; the transfer plunger comprises a first position which is completely provided in the sliding block and a second position which extends out of the sliding block to connect the sliding block and the housing into a whole; and the electric driving mechanism comprises an execution motor, a sliding plate frame, a sliding plate and a contact leaf spring, the execution motor can push the sliding plate to slide along the sliding plate frame, drive the contact leaf spring to push the execution plunger to slide, and drive the transfer plunger to move and keep the transfer plunger at the second position.

8 Claims, 9 Drawing Sheets

(56) References Cited

FOREIGN PATENT DOCUMENTS

| | | | |
|---|---|---|---|
| CN | 102444440 | A | 5/2012 |
| CN | 108661745 | A | 10/2018 |
| CN | 109184847 | A | 1/2019 |
| CN | 109372608 | A | 2/2019 |
| CN | 109707476 | A | 5/2019 |
| JP | 2000-291454 | A | 10/2000 |
| WO | WO 00/79107 | A1 | 12/2000 |

* cited by examiner

BRAKING DEVICE FOR ELECTRIC ENGINE

RELATED APPLICATIONS

The present application is a National Phase entry of PCT Application No. PCT/CN2019/103248, filed Aug. 29, 2019, which claims priority to Chinese Patent Application No. 201910758421.3, filed Aug. 16, 2019, the disclosures of which are hereby incorporated by reference herein in their entirety.

FIELD OF THE INVENTION

The invention relates to a medium-heavy-duty diesel and natural gas engine, in particular to a braking device for an electric engine.

BACKGROUND OF THE INVENTION

Auxiliary braking systems for vehicles are mainly divided into two types: a retarder and an engine braking system. The engine braking system is widely used because of its simple structure, convenient installation, low price and other advantages.

The engine braking technology refers to that a driver lifts an accelerator pedal and releases a clutch in the running process of an automobile, and the driver brakes the automobile by utilizing the compression resistance generated in a compression stroke of the engine, and a braking force formed by intake and exhaust resistance and a friction force on a driving wheel. The application of the engine braking technology effectively reduces the use frequency of a service brake. When the whole vehicle is running on steep roads such as long slopes, rough mountain roads and the like, the engine braking can be used to avoid the temperature rise of a brake friction plate, a reduced braking force, and even failed braking caused by a long-time use of the brake.

At present, a plurality of invention patents relate to the application of the technology. The main technology is that one or a plurality of auxiliary lifts are additionally included in a main lift of a cam, and a cam specially used for braking can also be added; and according to the working requirement of the engine, an engine braking device enables the auxiliary lift to act (realizes an engine braking function) or disables the auxiliary lift.

Patent CN200980158946.8 is a dedicated rocker arm type engine brake filed by Jacobs Vehicle Systems, Inc. and discloses a system for driving an engine exhaust valve comprising a rocker arm shaft having a control fluid supply passage, and an exhaust rocker arm pivotally mounted on the rocker arm shaft. The engine brake rocker arm may have a central opening, a hydraulic passage connecting the central opening to a control valve, and a fluid passage connecting the control valve to an actuating piston assembly.

Patent CN201080019296.1 is a lost motion variable valve actuation system for engine braking and exhaust pre-opening filed by Jacobs Vehicle Systems, Inc., which may include a first cam having a compression release bulge and an exhaust valve opening pre-opening bulge connected to a hydraulic lost motion system having a first rocker arm. A hydraulically actuated piston may be selectively extended from the hydraulic lost motion system to provide compression release actuation or exhaust valve pre-opening actuation to the exhaust valve. The hydraulically actuated piston may be disposed in a fixed housing as a slave piston in a master-slave piston circuit, or alternatively, slidably disposed in the rocker arm as a hydraulic piston.

Patent CN 200910140026.5 is an engine braking device with a valve auxiliary control unit and a method for engine braking, filed by German Mann Commercial Vehicle Co., Ltd., wherein the exhaust valve of braking device is connected to a camshaft by means of a mechanical connecting mechanism comprising a hydraulic valve auxiliary control unit. The hydraulic valve auxiliary control unit maintains the exhaust valve in a temporarily opened position. The hydraulic valve auxiliary control unit may be switched on and off by means of an auxiliary oil circuit additionally provided with respect to a main oil circuit of an internal combustion engine.

According to the engine braking patent, engine oil is used as a medium for transmitting the motion law of the valve which depends on some characteristics of the engine oil to a great extent. When the air content of the engine oil is too high, the lift of the braking valve may be lost to influence the braking performance. In addition, when the temperature of the engine oil is too low and the viscosity of the engine oil is too high, the normal operation of engine braking can be influenced. Therefore, all of the above engine braking techniques require that the engine braking be intervened when the engine oil temperature is higher than a certain limit value (e.g., 40° C.), thus limiting the operating conditions of the engine braking. If oil-driven engine braking is used, the time of engine braking intervention and exit is generally longer (>0.4 s), which has an effect on the transition process between engine braking and an ignition state, resulting in unstable transient transformation process.

SUMMARY OF THE INVENTION

To overcome the deficiencies of the prior art, the present invention provides an electric engine braking device.

The technical solution adopted by the invention is that an electric engine braking device comprises a rocker arm shaft;

a camshaft provided in parallel with the rocker arm shaft and having an exhaust cam (21) and an auxiliary cam which are arranged adjacently;

an exhaust valve comprising a first exhaust valve, a second exhaust valve, and a valve bridge which is transversely provided on the first exhaust valve and the second exhaust valve;

an exhaust rocker arm rotatably mounted on the rocker arm shaft, wherein a front end of the exhaust rocker arm correspondingly contacts with the valve bridge, and a rear end of the exhaust rocker arm correspondingly contacts with the exhaust cam;

an auxiliary rocker arm rotatably mounted on the rocker arm shaft and provided adjacently to the exhaust rocker arm, wherein a rear end of the auxiliary rocker arm corresponds to the auxiliary cam;

an elastic element capable of pressing the auxiliary rocker arm into contact with the auxiliary cam;

a sliding pin provided in the valve bridge, wherein one end of the sliding pin contacts with the first exhaust valve, and the other end of the sliding pin penetrates through the valve bridge;

a control mechanism provided at a front end of the auxiliary rocker arm and corresponding to the sliding pin, and comprising a housing, an execution plunger and a sliding assembly, wherein a first transverse hole and a longitudinal groove are formed in the housing; a lower end of the longitudinal groove is formed with an opening, and an upper end passes through the first transverse hole and intersects with the first transverse hole; the execution plunger is slidably provided in the first transverse hole, the sliding assembly is slidably provided in the longitudinal groove, one end of the execution plunger extends out of the first transverse hole, and the other end of the execution plunger abuts against the sliding assembly; the sliding assembly comprises a sliding block, a first elastic piece, a transfer plunger and a second elastic piece; the sliding block is in circumferential limiting and axial sliding fit with the longitudinal groove, and a lower end of the sliding block extends downwards out of the longitudinal groove, and the sliding block is further provided with a second transverse hole corresponding to the first transverse hole; the first elastic piece can drive the sliding block to move downwards and enable the second transverse hole to coincide with the first transverse hole; and the transfer plunger is slidably provided in the second transverse hole, and the length of the transfer plunger is less than or equal to that of the second transverse hole, and the second elastic piece can drive the transfer plunger to move towards one end of the execution plunger and enable an end face to be flush with an end face of the second transverse hole, wherein the transfer plunger has a first position completely provided in the second transverse hole, and a second position of the transfer plunger extending out of the second transverse hole opposite to the other end of the execution plunger to be locked with the housing; and an electric driving mechanism comprising an execution motor, a sliding plate frame, a sliding plate and a contact leaf spring, wherein the sliding plate frame is provided above the auxiliary rocker arm, the sliding plate is provided in parallel with the rocker arm shaft and is slidably provided on the sliding plate frame; the contact leaf spring is mounted on the sliding plate and correspondingly contacts with the execution plunger; and an output end of the execution motor is in linkage fit with the sliding plate, enabling to push the sliding plate to slide along the sliding plate frame.

An upper end of the longitudinal groove is provided with a spring slot, and a lower end of the longitudinal groove is provided with a first limiting ring; the sliding block is in a convex shape, the lower end of the sliding block penetrates through and is in limiting fit with the first limiting ring; and the first elastic piece is a spring and is provided in the spring slot, and two ends of the first elastic piece respectively abut against the housing and the sliding block.

The second transverse hole is a stepped hole and sequentially comprises a large hole, a middle hole and a small hole, wherein the small hole is the same as the first transverse hole; the transfer plunger is matched with the small hole, a first annular boss matched with the middle hole is formed on an outer ring of the transfer plunger, and the first annular boss is in a cross shape; a second limiting ring is mounted in the large hole and is in limiting fit with the first annular boss of the transfer plunger; and the second elastic piece is a spring and is sleeved outside the transfer plunger, and the two ends of the second elastic piece respectively abut against the sliding block and the first annular boss.

A second annular boss is formed on the outer ring of the execution plunger, and the second annular boss is in a cross shape integrally; and a third limiting ring is provided at an end of the first transverse hole, and the execution plunger extends out of the first transverse hole through the third limiting ring and is in limiting fit with the third limiting ring through the second annular boss.

A longitudinal hole is formed in the front end of the auxiliary rocker arm, a longitudinal guide slot is formed in a side wall of the longitudinal hole, an adjusting bolt is provided at an upper end of the longitudinal hole, and a fourth limiting ring is provided at a lower end of the longitudinal hole; the housing is slidably provided in the longitudinal hole, the execution plunger extends out of the auxiliary rocker arm through the longitudinal guide slot, and the sliding block extends downwards below the longitudinal hole through the fourth limiting ring; and a third elastic piece is further provided between the fourth limiting ring and the housing, and the third elastic piece can drive the housing to be in contact with the adjusting bolt.

Two longitudinal guide slots are symmetrically provided in the side wall of the longitudinal hole; two guide bosses are correspondingly provided at two sides of the housing, and the housing is in a cross shape integrally; and the guide bosses are correspondingly provided in the longitudinal guide slots, and the first transverse holes are provided through the two guide bosses.

The execution motor is a rotary motor, an execution rod is vertically provided on an output shaft of the execution motor, an execution hole matched with the execution rod is provided on the sliding plate, and the execution rod penetrates through the execution hole.

The execution motor is a linear motor, and a guide frame corresponding to the output end of the execution motor is provided on the sliding plate; and a reset elastic piece is further provided between the sliding plate frame and the contact leaf spring.

The working process of the engine braking device comprises the following steps.

When the engine normally works, the execution motor does not work, the transfer plunger is in the first position under the action of the second elastic piece, and the sliding block and the housing are not in a locking state; when the auxiliary cam lift drives the auxiliary rocker arm to rotate, the sliding pin is contacted with the sliding block to drive the sliding block to move upwards against the elastic force of the first elastic piece, and the elastic force of the first elastic piece is not enough to drive the sliding pin to exhaust, without influencing the movement of the exhaust valve, and ensuring normal operation of the engine.

When the engine braking works, the motor is operated, the sliding plate and the contact leaf spring are used for pushing the action of the execution plunger, the transfer plunger is pushed to enter the second transverse hole by the execution plunger, and the transfer plunger moves against the elastic force of the second elastic piece and extends out of the second transverse hole to be in the second position, so that the sliding block and the housing are in a locking state, and when the auxiliary cam lift drives the auxiliary rocker arm to rotate, the sliding block contacts with the sliding pin; and the sliding pin is driven to move and open the first exhaust valve, so that the purpose of engine braking is achieved.

When the engine returns to normal operation, the motor is operated, the sliding plate and the contact leaf spring are reset, the transfer plunger returns to the first position under the action of the second elastic piece, the execution plunger is pushed out of the second transverse hole, and the sliding block and the housing are in an unlocked state; when the auxiliary cam lift drives the auxiliary rocker arm to rotate, the sliding pin contacts with the sliding block, the sliding block is driven to move upwards against the elastic force of the first elastic piece, and the elastic force of the first elastic piece is not enough to drive the sliding pin to exhaust, without influencing the movement of the exhaust valve, and ensuring normal operation of the engine.

The invention has following beneficial effects. 1. Eliminating reliability risks caused by using engine oil: an engine braking device is driven by an electric control mechanism to solve the problems of unstable idling speed and white smoke generation from misoperation of a braking function caused by high engine oil viscosity and pressure when the engine is started.

2. Increasing the service area of engine braking: at present, due to the fact that the engine oil is used as a working medium for a hydraulic or mechanical linkage type engine braking, there are certain requirements on the temperature and the pressure of the engine oil. For example, only when the temperature of the engine oil is required to be greater than 40° C., the engine braking can be intervened, thus limiting the use of engine braking when the whole vehicle just starts. By the use of the electric control mechanism, it is not limited by the conditions, and the engine braking can be used at any time after the whole vehicle is started.

3. Shortening the engine braking entry and exit time obviously: in traditional hydraulic or mechanical linkage type engine braking, as engine oil is used as a working medium or a driving control medium, the entry and exit time of engine braking is long, generally with 0.2s-0.4s. Moreover, the engine braking device is driven by an electric control mechanism to complete the switching of positive work and negative work in one revolution of a camshaft, so that the entering and exiting speed of engine braking is increased by 4-5 times.

4. Reducing fuel consumption of the engine: by adopting the electric control mechanism, engine oil is not required to serve as a driving medium, the engine oil demand and oil supply capacity of an oil pump can be properly reduced, so that the reduction of fuel consumption is facilitated.

DETAILED DESCRIPTION OF THE INVENTION

Embodiments of the present invention will now be further described with reference to the accompanying drawings.

Figure 1:
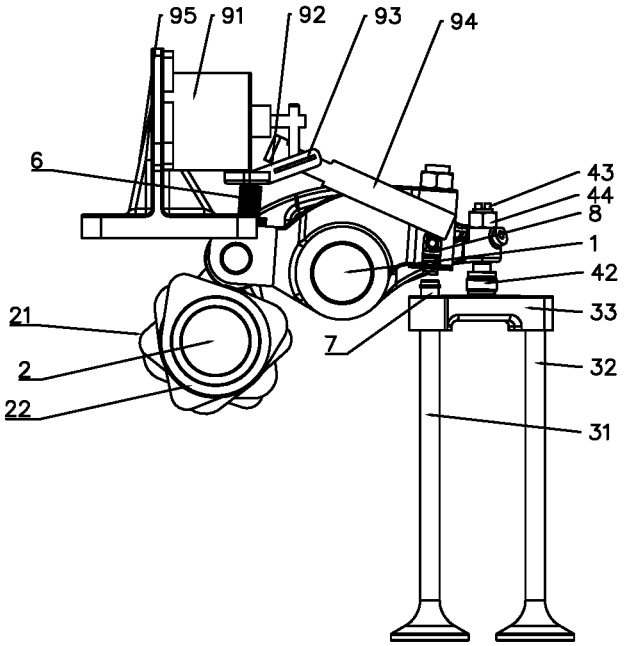
FIG. 1 is a schematic diagram showing a front view structure of an engine braking device according to an embodiment of the present invention.
Figure 2:
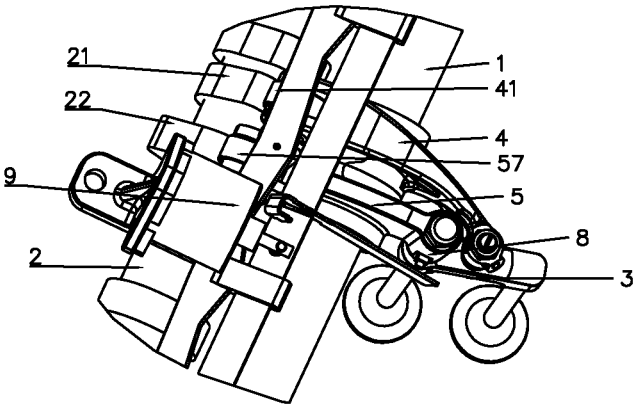
FIG. 2 is a partial perspective view showing the engine braking device according to an embodiment of the present invention.
Figure 3:
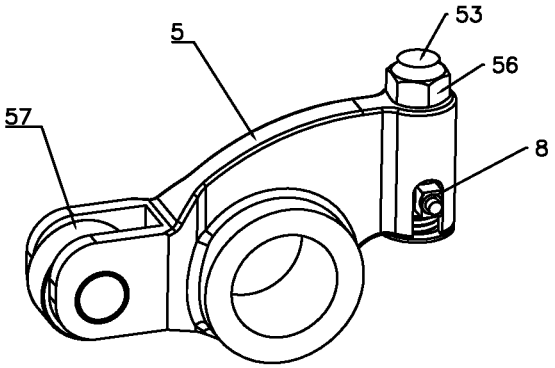
FIG. 3 is a structurally schematic diagram showing an auxiliary rocker arm and a control mechanism according to an embodiment of the invention.
Figure 4:
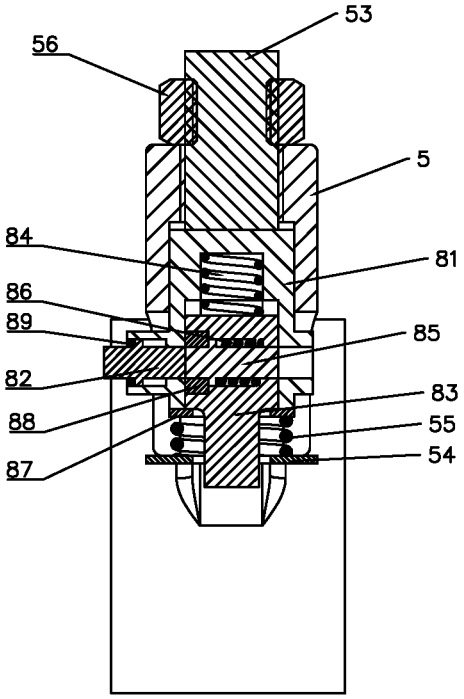
FIG. 4 is a cross-sectional view of the control mechanism of an embodiment of the present invention in a first position.
Figure 5:
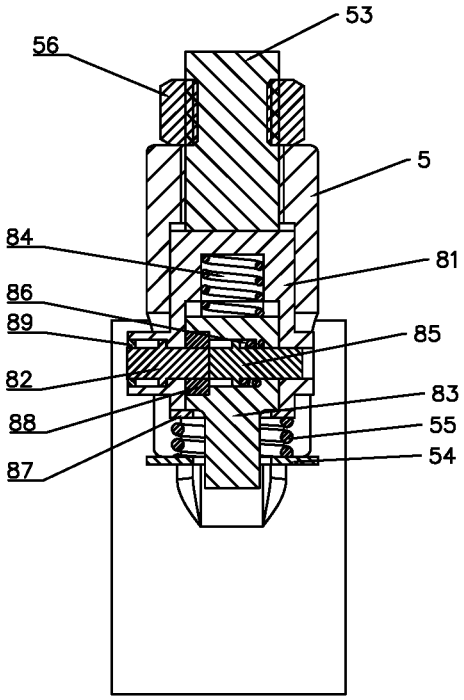
FIG. 5 is a cross-sectional view of the control mechanism according to an embodiment of the present invention in a second position.
Figure 6:
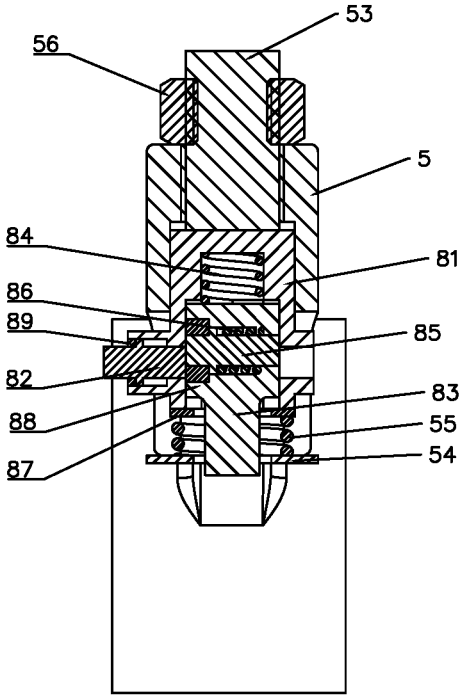
FIG. 6 is a cross-sectional view of the control mechanism according to an embodiment of the invention after the sliding block moves to compress the first elastic piece when the control mechanism is in the first position.
Figure 7:
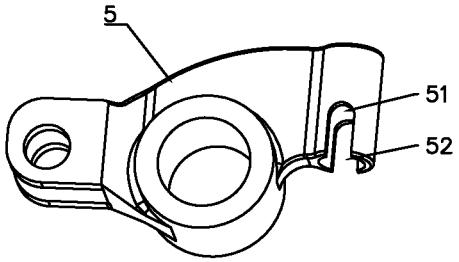
FIG. 7 is a structurally schematic diagram showing the auxiliary rocker arm according to an embodiment of the present invention.
Figure 8:
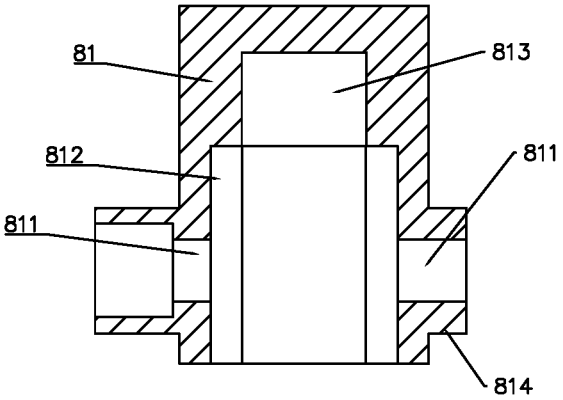
FIG. 8 is a cross-sectional view of a housing according to an embodiment of the present invention.
Figure 9:
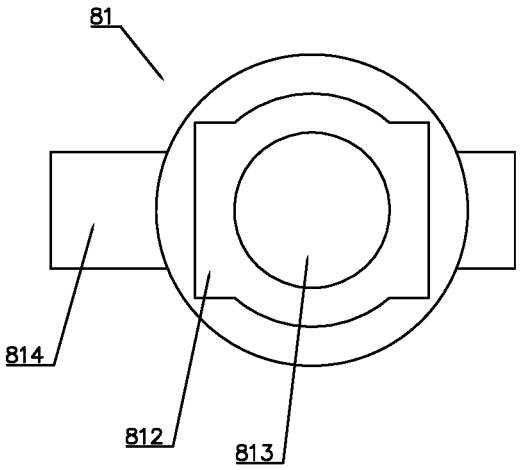
FIG. 9 is a bottom view of the housing according to an embodiment of the present invention.
Figure 10:
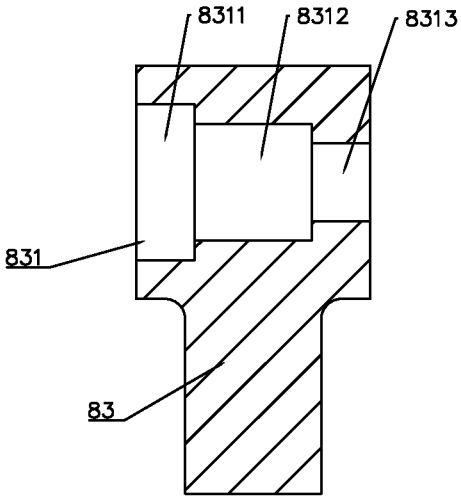
FIG. 10 is a cross-sectional view of a sliding block according to an embodiment of the present invention.
Figure 11:
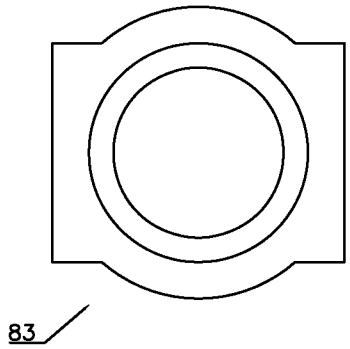
FIG. 11 is a bottom view of the sliding block according to an embodiment of the present invention.
Figure 12:
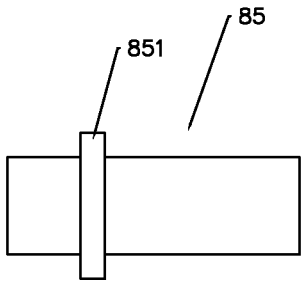
FIG. 12 is a structurally schematic diagram showing a transfer plunger according to an embodiment of the present invention.
Figure 13:
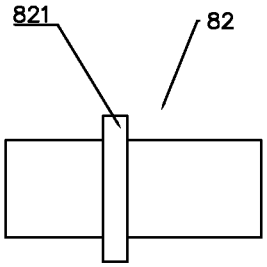
FIG. 13 is a cross-sectional view of an execution plunger according to an embodiment of the present invention.
Figure 14:
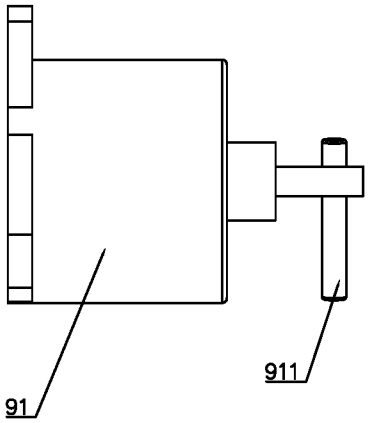
FIG. 14 is a schematic view showing a structure of an actuator according to an embodiment of the present invention.
Figure 15:
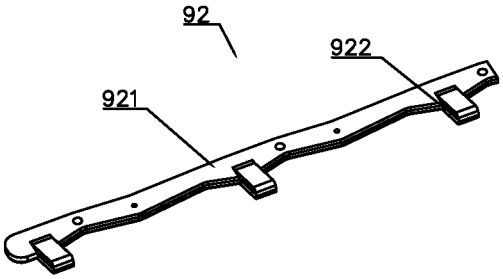
FIG. 15 is a structurally schematic diagram showing a sliding plate frame according to an embodiment of the present invention.
Figure 16:
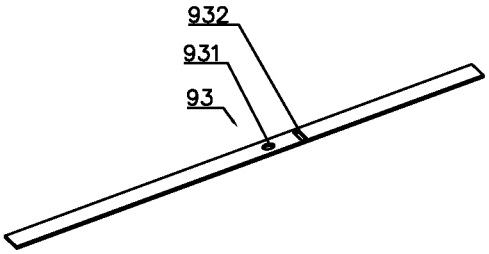
FIG. 16 is a structurally schematic diagram showing a sliding plate according to an embodiment of the present invention.
Figure 17:
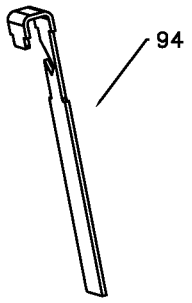
FIG. 17 is a structurally schematic diagram showing a contact leaf spring according to an embodiment of the present invention.
Figure 18:
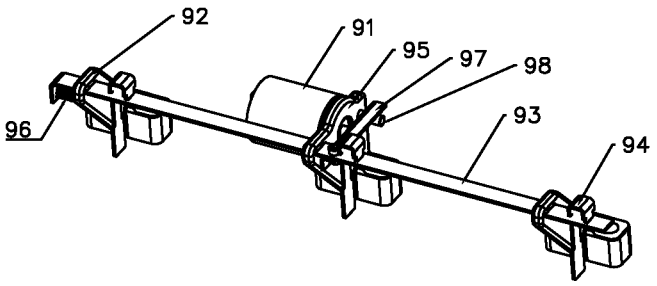
FIG. 18 is a structurally schematic diagram showing a motor driving mechanism according to another embodiment of the present invention.
Figure 19:
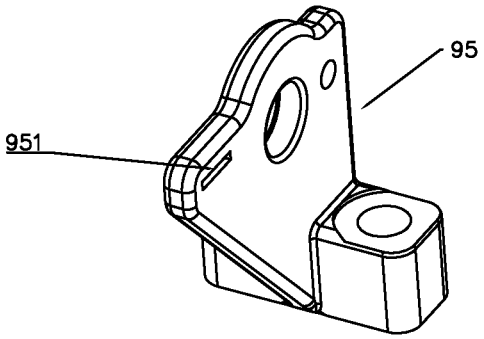
FIG. 19 is a structurally schematic diagram showing a motor base according to another embodiment of the present invention.
Figure 20:
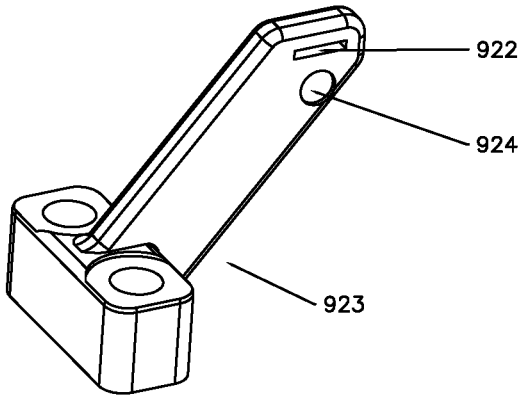
FIG. 20 is a structurally schematic diagram showing a sliding plate frame according to another embodiment of the present invention.
Figure 21:
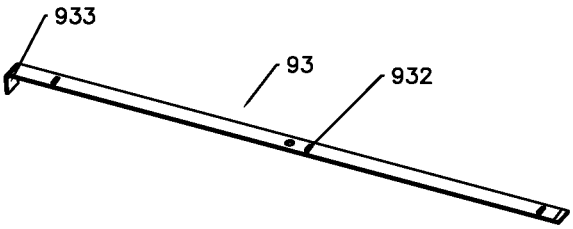
FIG. 21 is a structurally schematic diagram showing a sliding plate according to another embodiment of the present invention.
Figure 22:
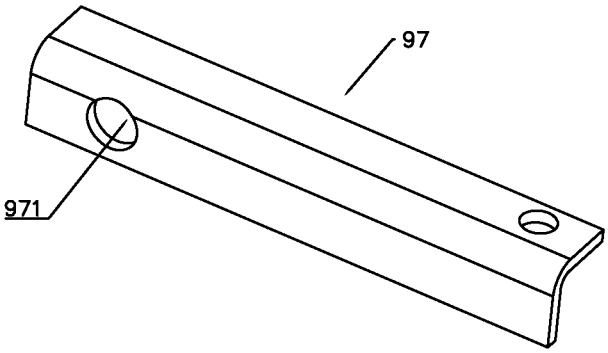
FIG. 22 is a structurally schematic diagram showing a guide frame according to another embodiment of the present invention.

As shown in FIGS. 1 and 2, an engine braking device comprises a rocker arm shaft 1, a camshaft 2, an exhaust valve 3, an exhaust rocker arm 4, an auxiliary rocker arm 5, an elastic element 6, a sliding pin 7, a control mechanism 8, and an electric driving mechanism 9.

The rocker arm shaft 1 is provided in parallel with the camshaft 2, the camshaft 2 is provided with an exhaust cam 21 and an auxiliary cam 22 which are arranged adjacently, and the camshaft 2 can rotate to simultaneously drive the exhaust cam 21 and the auxiliary cam 22 to rotate.

The exhaust valve 3 comprises a first exhaust valve 31, a second exhaust valve 32 and a valve bridge 33 transversely provided on the first exhaust valve 31 and the second exhaust valve 32, wherein the first exhaust valve 31 and the second exhaust valve 32 adopt a mushroom valve for controlling the flow of gas between a combustion chamber and intake and exhaust manifolds in the engine.

The exhaust rocker arm 4 is rotatably mounted on the rocker arm shaft 1, a front end of the exhaust rocker arm 4 correspondingly contacts with the valve bridge 33, and a rear end of the exhaust rocker arm 4 correspondingly contacts with the exhaust cam 21, so that along with the rotation of the camshaft 2, the exhaust rocker arm 4 can rotate and swing around the rocker arm shaft 1 under the joint action of the exhaust cam 21 and the exhaust valve 3, so as to enable an exhaust stroke of the exhaust valve 3 by the exhaust cam 21 and the exhaust rocker arm 4.

The rear end of the exhaust rocker arm 4 is provided with a first roller 41 via a first roller shaft, and the first roller 41 contacts with the exhaust cam 21. As the exhaust cam 21 is in rolling fit with the first roller 41, friction force between the exhaust cam 21 and the exhaust rocker arm 4 is greatly reduced, abrasion is reduced, and service life is prolonged.

The front end of the exhaust rocker arm 4 is further provided with an adjusting bolt 43, an image angle 42 and a fastening nut 44; the image angle 42 is press-fitted at a lower end of the adjusting bolt 43 via a special tool, and can freely rotate in a certain angle; an upper end of the adjusting bolt 43 protrudes from the top of the front end of the exhaust rocker arm 4 and is locked and fixed by the fastening nut 44, with a firmer and more reliable connection; the image angle 42 contacts with the valve bridge 33, and since the degree of freedom of the image angle 42 is high, the contact effect thereof with the valve bridge 33 is ensured and the working stability is ensured along with a swinging action of the exhaust rocker arm 4.

The auxiliary rocker arm 5 is rotatably mounted on the rocker arm shaft 1 and is provided adjacently to the exhaust rocker arm 4, and a rear end of the auxiliary rocker arm 5 corresponds to the auxiliary cam 22 and is pressed into contact with the auxiliary cam 22 by the elastic element 6, so that when the camshaft 2 rotates, the auxiliary cam 22 can drive the auxiliary rocker arm 5 to rotate and swing along the rocker arm shaft 1.

Similarly, a second roller 57 can be mounted at the rear end of the auxiliary rocker arm 5 by a second roller shaft, the second roller 57 contacts with the auxiliary cam 22, and a rolling fit is formed between the auxiliary cam 22 and the second roller 57 to greatly reduce the friction force between the auxiliary cam 22 and the auxiliary rocker arm 5, decrease the abrasion, and prolong the service life.

Here, the auxiliary cam 22 includes a base circle and one or two cam lobes. For example, two cam lobes are provided in this embodiment, including a brake cam lobe for providing a brake lift, an optional EGR cam lobe for providing an EGR lift when the engine makes positive work, or an optional BGR cam lobe for providing a BGR lift when the engine is braked.

In addition, the elastic element 6 has many alternatives. In the present embodiment, the elastic element 6 is a spring, one end of which is fixed to the rear end of the auxiliary rocker arm 5, and the other end of which is fixed to a spring bracket (not shown in the drawing); the spring bracket is fixed to an engine cylinder head or other fixed components; during operation of the engine, the elastic element 6 has sufficient spring force to keep the engine auxiliary rocker arm 5 always in contact with the auxiliary cam 22.

Of course, during operation of the engine, the auxiliary rocker arm 5 may be held in contact with the auxiliary cam 22 by other means such as leaf springs, torsion springs, etc.

The sliding pin 7 is provided in the valve bridge 33, one end of the sliding pin 7 contacts with the first exhaust valve 31, and the other end of the sliding pin 7 penetrates out of the valve bridge 33. When the sliding pin 7 is subjected to a large enough acting force, it pushes the first exhaust valve 31 to act, so that the exhaust stroke of the first exhaust valve 31 is realized.

As shown in FIGS. 3-13, the control mechanism 8 is provided at the front end of the auxiliary rocker arm 5 and corresponds to the sliding pin 7, and includes a housing 81, an execution plunger 82, and a sliding assembly.

A first transverse hole 811 and a longitudinal groove 812 are formed in the housing 81, a lower end of the longitudinal groove 812 is formed with an opening, and an upper end of the longitudinal groove 812 passes through the first transverse hole 811 and intersects with the first transverse hole 811.

A second annular boss 821 is formed on the outer ring of the execution plunger 82, and the second annular boss 821 is in a cross shape integrally; a third limiting ring 89 is provided at an end of the first transverse hole 811; and the execution plunger 82 is slidably provided in the first transverse hole 811, one end of the execution plunger 82 passes through the third limiting ring 89 and then extends out of the first transverse hole 811, and the execution plunger 82 is in limiting fit with the third limiting ring 89 via the second annular boss 821.

The sliding assembly is slidably provided in a longitudinal groove 812 and includes a sliding block 83, a first elastic piece 84, a transfer plunger 85, and a second elastic piece 86.

The sliding block 83 and the longitudinal groove 812 form a matching relationship of circumferential limiting axial sliding, and the sliding block 83 can only slide along the longitudinal groove 812 and cannot rotate by the matching of four right-angle surfaces.

An upper end of the longitudinal groove 812 is provided with a spring slot 813, and a lower end of the longitudinal groove 812 is provided with a first limiting ring 87; the sliding block 83 is in a convex shape, the lower end of the sliding block 83 penetrates through and is in limiting fit with the first limiting ring 87; and the first elastic piece 84 is a spring and is provided in the spring slot 813, and two ends of the first elastic piece 84 abut against the housing 81 and the sliding block 83 respectively, so that the sliding block 83 can be driven to slide downwards to keep limiting contact with the first limiting ring 87.

The sliding block 83 is further provided with a second transverse hole 831 corresponding to the first transverse hole 811, and the second transverse hole 831 of the sliding block 83 is just coincident with the first transverse hole 811 when the sliding block 83 is kept in a contact limiting position with the first limiting ring 87 under the action of the first elastic piece 84.

The second transverse hole 831 is a stepped hole and sequentially comprises a large hole 8311, a middle hole 8312 and a small hole 8313, wherein the large hole 8311 is close to one end of the execution plunger 82, and the small hole 8313 is consistent with the first transverse hole 811.

The length of sliding of the transfer plunger 85 is less than or equal to the length of the second transverse hole 831, the transfer plunger 85 is provided in the second transverse hole 831 and is matched with the small hole 8313, a first annular boss 851 matched with the middle hole 8312 is formed on the outer ring of the transfer plunger 85, and the first annular boss 851 is in a cross shape; a second limiting ring 88 is mounted in the large hole 8311; and the second elastic piece 86 is a spring and is sleeved outside the transfer plunger 85, two ends of the second elastic piece 86 abut against the sliding block 83 and the first annular boss 851 respectively, so that the transfer plunger 85 can be driven to slide towards the second limiting ring 88 and keep the first annular boss 851 in limiting contact with the second limiting ring 88.

When the transfer plunger 85 is held in a contact limiting position with the second limiting ring 88 under the action of the second elastic piece 86, the transfer plunger 85 is completely provided in the second transverse hole 831, and one end of the transfer plunger 85 is flush with an end surface of the second transverse hole 831.

When the execution plunger 82 is moved by an external force, the transfer plunger 85 can be pushed to move. When the execution plunger 82 is not moved by other external force, the transfer plunger 85 is reset under the action of the second elastic piece 86, and the execution plunger 82 is pushed to reset, so that the transfer plunger 85 has a first position completely provided in the second transverse hole 831, and a second position of the transfer plunger 85 extending out of the second transverse hole 831 relative to the other end of the execution plunger 82 to be locked with the housing 81.

In addition, the front end of the auxiliary rocker arm 5 is provided with a longitudinal hole 51, a side wall of the longitudinal hole 51 is provided with a longitudinal guide slot 52, an upper end of the longitudinal hole 51 is provided with an adjusting bolt 53, and the adjusting bolt 53 is fixed and locked via a locking nut 56.

A fourth limiting ring 54 is further provided at the lower end of the longitudinal hole 51; the housing 81 is slidably provided in the longitudinal bore 51, the execution plunger 82 extends out of the auxiliary rocker arm 5 through the longitudinal guide slot 52, and the sliding block 83 extends downwards below the longitudinal bore 51 through the fourth retainer ring 54.

A third elastic piece 55 is further provided between the fourth limiting ring 54 and the housing 81, the third elastic piece 55 is usually a spring, two ends of the third elastic piece 55 abut against the housing 81 and the fourth limiting ring 54 respectively, and the housing 81 can be driven to be in contact with the adjusting bolt 53.

Compared with directly fixing the housing 81 at the front end of the auxiliary rocker arm 5, the structure enables the housing 81 to float up and down to drive the control mechanism 8 to float up and down integrally; and the position of the control mechanism 8 can be finely adjusted by adjusting the bolt 53 and matching with the third elastic piece 55 so as to adjust the distance between the sliding block 83 and the sliding pin 7.

The two longitudinal guide slots 52 are symmetrically provided in the side wall of the longitudinal hole 51; two guide bosses 814 are correspondingly provided at two sides of the housing 81, and the housing 81 is in a cross shape integrally; the guide bosses 814 are correspondingly provided in the longitudinal guide slots 52, and the first transverse holes 811 are provided through the two guide bosses 814.

As shown in FIGS. 1, 2, and 14-17, the electric driving mechanism 9 includes an execution motor 91, a sliding plate frame 92, a sliding plate 93, and a contact leaf spring 94.

The sliding plate frame 92 is fixedly mounted on an engine cylinder head or other fixed components and comprises a mounting plate 921, wherein side edges of the mounting plate 921 are sequentially provided with a plurality of sliding slots 922 at intervals along a length direction of the mounting plate 921, and the mounting plate 921 is provided above the auxiliary rocker arm 5 and has the length direction parallel to the rocker arm shaft 1.

The sliding plate 93 is of a long strip-shaped structure, and penetrates through the sliding slot 922 to be in sliding fit with the sliding slot 922, and the sliding plate 93 is provided with an execution hole 931 and a plurality of clamping slots 932.

The execution motor 91 is fixedly mounted on an engine cylinder head or other fixed components via a motor base 95. The execution motor 91 adopts a rotating motor, an execution rod 911 is vertically provided on an output shaft of the execution motor 91, and the execution rod 911 penetrates through an execution hole 931. When the execution motor 91 rotates, the execution rod 911 can be driven to rotate, so that the sliding plate 93 can be driven to slide along the sliding slot 922.

The contact leaf spring 94 is in a 7-shaped structure, the sliding plate 93 is provided with a clamping slot 932 matched with the contact leaf spring 94, and an upper end of the contact leaf spring 94 penetrates through the clamping slot 932 and is bent to be in limiting fit with the sliding plate 93, with convenient installation.

When the engine is braked or EGR works, the execution motor 91 rotates to drive the sliding plate 93 to slide via the execution rod 911, and the sliding plate drives the contact leaf spring 94 to move synchronously, so that the contact leaf spring 94 contacts with the execution plunger 82 and pushes the execution plunger 82, and the execution plunger 82 can push the transfer plunger 85 to move against the elastic force of the second elastic piece 86 to slide to the second position.

When the engine returns to normal work, the execution motor 91 reversely rotates and resets, the execution rod 911 can drive the sliding plate 93 to slide and reset, and the sliding plate 93 drives the contact leaf spring 94 to move, so that the contact leaf spring 94 is separated from the execution plunger 84; and the transfer plunger 85 can reset and slide to the first position under the action of the second elastic piece 86, and the execution plunger 82 is pushed to reset.

The contact leaf spring 94 is in surface contact with an execution part 841 of the execution plunger 84, so that when the auxiliary rocker arm 5 rotates, the contact between the contact leaf spring 94 and the execution part 841 is ensured, the execution plunger 84 is kept in the first position; and when the contact leaf spring 94 contacts with the execution part 841 of the execution plunger 84 by adopting the structure of the contact leaf spring 94, the elastic property of the contact leaf spring 94 itself is utilized, so that a certain over travel distance is provided and the matching stability is guaranteed during the contact process.

In addition, the sliding plate 93 is provided with a plurality of contact leaf springs 94, and each contact leaf spring 94 is arranged at intervals and can respectively correspond to each group of engine braking devices; and each cylinder acts synchronously, the structure is more compact, and braking is fast and stable.

Referring to FIGS. 18-22, another implementation of the electric driving mechanism 9 includes an execution motor 91, a sliding plate frame 92, a sliding plate 93, and a contact leaf spring 94.

The sliding plate frame 92 comprises a plurality of mounting bases 923 which are arranged at intervals and are fixedly mounted on an engine cylinder head or other fixed components; The mounting bases 923 are correspondingly provided with sliding slots 922, and one mounting base 923 at one end is further provided with a spring slot 924.

The sliding plate 93 is of a long strip-shaped structure, penetrates through the sliding slot 922 to be in sliding fit with the sliding slot 922, and one end of the sliding plate 93 corresponding to the spring slot 924 is bent to form a spring seat 933.

A return elastic piece 96 is provided between the spring seat 933 and the spring slot 924 and is a spring, and two ends of the return elastic piece abut against the spring seat 933 and the spring slot 924 respectively.

The execution motor 91 is fixedly mounted on an engine cylinder head or other fixed components via a motor base 95, the execution motor 91 is a linear motor, and a guide frame 97 corresponding to the output end of the execution motor 91 is provided on the sliding plate 93.

In order to further ensure motion stability, a second sliding slot 951 corresponding to the sliding slot 922 is provided on the motor base 95, the sliding plate 93 simultaneously penetrates through the second sliding slot 951, a guide shaft 98 is provided on the motor base 95, a guide hole 971 matched with the guide frame 97 is provided on the guide frame 97, and the guide shaft 98 penetrates through the guide hole 971, so that the motion of the guide frame 97 is stable when the guide frame 97 translates.

When the engine is braked or EGR works, the execution motor 91 rotates, the output end of the execution motor 91 pushes the guide frame 97 to translate, the guide frame 97 drives the sliding plate 93 to slide, and the sliding plate 93 drives the contact leaf spring 94 to synchronously move, so that the contact leaf spring 94 contacts with the execution plunger 82 and pushes the execution plunger 82, and the execution plunger 82 can push the transfer plunger 85 to move against the elastic force of the second elastic piece 86 to slide to the second position.

When the engine returns to normal work, the execution motor 91 reversely rotates to retract the output end, the sliding plate 93 resets at the reset elastic piece 96 and drives the contact leaf spring 94 and the guide frame 97 to reset, the transfer plunger 85 can reset and slide to the first position under the action of the second elastic piece 86, and meanwhile the execution plunger 82 is pushed to reset.

The working process of the engine braking device comprises the following steps.

When the engine normally works, the execution motor 91 does not work, the transfer plunger 85 is in a first position under the action of the second elastic piece 86, and the sliding block 83 is not locked; when the auxiliary cam 22 lift drives the auxiliary rocker arm 5 to rotate, the sliding pin 7 and the sliding block 83 drive the sliding block 83 to move upwards against the elastic force of the first elastic piece 84, and the elastic force of the first elastic piece 84 is not enough to drive the sliding pin 7 to exhaust, without influencing the movement of the exhaust valve, and ensuring normal operation of the engine.

When the engine is braked, the motor 91 is operated; the sliding plate 93 and the contact leaf spring 94 push the execution plunger 82 to move, the execution plunger 82 can push the transfer plunger 85 to move against the elastic force of the second elastic piece 86 to slide to the second position; thus, the sliding block 83 is integrated with the housing 81; and when the auxiliary cam 22 lift drives the auxiliary rocker arm 5 to rotate, the sliding block 83 contacts with the sliding pin 7, and the sliding pin 7 is driven to move and open the first exhaust valve, so that the purpose of engine braking is achieved.

When the engine returns to normal operation, the motor 91 is operated, the sliding plate 93 and the contact leaf spring 94 are reset, the transfer plunger 85 can reset and slide to the first position under the action of the second elastic piece 86, the execution plunger 82 is pushed out of the second transverse hole, the sliding block 83 and the housing 81 are not locked; and when the auxiliary cam 22 lift drives the auxiliary rocker arm 5 to rotate, the sliding pin 7 contacts with the sliding block 83, and the sliding block 83 is driven to move upwards against the elastic force of the first elastic piece 84, without influencing the movement of the exhaust valve, and ensuring normal operation of the engine.

Compared with an existing engine braking device adopting engine oil as a medium for transmitting the motion law of a valve, the electric engine braking device has the following advantages.

1. Eliminating reliability risks caused by using engine oil: an engine braking device is driven by an execution motor and matched by a purely mechanical linkage structure to solve the problems of unstable idling speed and white smoke generation from misoperation of a braking function caused by high engine oil viscosity and pressure when the engine is started;

2. Increasing the service area of engine braking: at present, due to the fact that the engine oil is used as a working medium for a hydraulic or mechanical linkage type engine braking, there are certain requirements on the temperature and the pressure of the engine oil. For example, only when the temperature of the engine oil is required to be greater than 40° C., the engine braking can be intervened, thus limiting the use of engine braking when the whole vehicle just starts. By the use of the execution motor driving and with purely mechanical linkage structure matching, the engine braking is not limited by the conditions, and can be used at any time after the whole vehicle is started;

3. Shortening the engine braking entry and exit time obviously: in traditional hydraulic or mechanical linkage type engine braking, as engine oil is used as a working medium or a driving control medium, the entry and exit time of engine braking is long, generally with 0.2s-0.4s. Moreover, the engine braking device is driven by an execution motor to complete the switching of positive work and negative work in one revolution of a camshaft with purely mechanical linkage structure matching, so that the entering and exiting speed of engine braking is increased by 4-5 times.

4. Reducing fuel consumption of the engine: by adopting the execution motor driving and with the mechanical linkage structure matching, engine oil is not required to serve as a driving medium, the engine oil demand and oil supply capacity of an oil pump can be properly reduced, so that the reduction of fuel consumption is facilitated.

One skilled in the art will recognize that: although the present invention has been described in accordance with the above specific embodiments, the inventive concept of the present invention is not limited to this invention, and any modifications using the inventive concept are intended to be included within the scope of this patent.

The invention claimed is:

1. An electric engine braking device, comprising:

a rocker arm shaft;

a camshaft provided in parallel with the rocker arm shaft and having an exhaust cam and an auxiliary cam which are arranged adjacently;

an exhaust valve comprising a first exhaust valve, a second exhaust valve, and a valve bridge which is transversely provided on the first exhaust valve and the second exhaust valve;

an exhaust rocker arm rotatably mounted on the rocker arm shaft, wherein a front end of the exhaust rocker arm correspondingly contacts with the valve bridge, and a rear end of the exhaust rocker arm correspondingly contacts with the exhaust cam;

an auxiliary rocker arm rotatably mounted on the rocker arm shaft and provided adjacently to the exhaust rocker arm, wherein a rear end of the auxiliary rocker arm corresponds to the auxiliary cam;

an elastic element capable of pressing the auxiliary rocker arm into contact with the auxiliary cam;

a sliding pin (7) provided in the valve bridge, wherein one end of the sliding pin contacts with the first exhaust valve, and the other end of the sliding pin penetrates through the valve bridge;

a control mechanism provided at a front end of the auxiliary rocker arm and corresponding to the sliding pin, and comprising a housing, an execution plunger and a sliding assembly, wherein a first transverse hole and a longitudinal groove are formed in the housing; a lower end of the longitudinal groove is formed with an opening, and an upper end passes through the first transverse hole and intersects with the first transverse hole; the execution plunger is slidably provided in the first transverse hole, the sliding assembly is slidably provided in the longitudinal groove, one end of the execution plunger extends out of the first transverse hole, and the other end of the execution plunger abuts against the sliding assembly; the sliding assembly comprises a sliding block, a first elastic piece, a transfer plunger and a second elastic piece; the sliding block is in circumferential limiting and axial sliding fit with the longitudinal groove, and a lower end of the sliding block extends downwards out of the longitudinal groove, and the sliding block is further provided with a second transverse hole corresponding to the first transverse hole; the first elastic piece can drive the sliding block to move downwards and enable the second transverse hole to coincide with the first transverse hole; and the transfer plunger is slidably provided in the second transverse hole, and the length of the transfer plunger is less than or equal to that of the second transverse hole, and the second elastic piece can drive the transfer plunger to move towards one end of the execution plunger and enable an end face to be flush with an end face of the second transverse hole, wherein the transfer plunger has a first position completely provided in the second transverse hole, and a second position of the transfer plunger extending out of the second transverse hole relative to the other end of the execution plunger to be locked with the housing; and an electric driving mechanism comprising an execution motor, a sliding plate frame, a sliding plate and a contact leaf spring, wherein the sliding plate frame is provided above the auxiliary rocker arm, the sliding plate is provided in parallel with the rocker arm shaft and is slidably provided on the sliding plate frame; the contact leaf spring is mounted on the sliding plate and correspondingly contacts with the execution plunger; and an output end of the execution motor is in linkage fit with the sliding plate, enabling to push the sliding plate to slide along the sliding plate frame.

2. The electric engine braking device according to claim 1, wherein an upper end of the longitudinal groove is provided with a spring slot, and a lower end of the longitudinal groove is provided with a first limiting ring; the sliding block is in a convex shape, the lower end of the sliding block penetrates through and is in limiting fit with the first limiting ring; and the first elastic piece is a spring and is provided in the spring slot, and two ends of the first elastic piece abut against the housing and the sliding block respectively.

3. The electric engine braking device according to claim 1, wherein the second transverse hole is a stepped hole and sequentially comprises a large hole, a middle hole and a small hole, wherein the small hole is the same as the first transverse hole; and the transfer plunger is matched with the small hole, a first annular boss matched with the middle hole is formed on an outer ring of the transfer plunger, and the first annular boss is in a cross shape; a second limiting ring is mounted in the large hole and is in limiting fit with the first annular boss of the transfer plunger; and the second elastic piece is a spring and is sleeved outside the transfer plunger, and the two ends of the second elastic piece abut against the sliding block and the first annular boss respectively.

4. The electric engine braking device according to claim 1, wherein a second annular boss is formed on the outer ring of the execution plunger, and the second annular boss is in a cross shape; and a third limiting ring is provided at an end of the first transverse hole, and the execution plunger extends out of the first transverse hole through the third limiting ring and is in limiting fit with the third limiting ring through the second annular boss.

5. The electric engine braking device according to claim 1, wherein a longitudinal hole is formed in the front end of the auxiliary rocker arm, a longitudinal guide slot is formed in a side wall of the longitudinal hole, an adjusting bolt is provided at an upper end of the longitudinal hole, and a fourth limiting ring is provided at a lower end of the longitudinal hole;

the housing is slidably provided in the longitudinal hole, the execution plunger extends out of the auxiliary rocker arm through the longitudinal guide slot and the sliding block extends downwards below the longitudinal hole through the fourth limiting ring; and a third elastic piece is further provided between the fourth limiting ring and the housing, and the third elastic piece can drive the housing to be in contact with the adjusting bolt.

6. The electric engine braking device according to claim 5, wherein two longitudinal guide slots are symmetrically provided in the side wall of the longitudinal hole; two guide bosses are correspondingly provided at two sides of the housing, and the housing is in a cross shape integrally; and the guide bosses are correspondingly provided in the longitudinal guide slots, and the first transverse holes are provided through the two guide bosses.

7. The electric engine braking device according to claim 1, wherein the execution motor is a rotary motor, an execution rod is vertically provided on an output shaft of the execution motor, an execution hole matched with the execution rod is provided on the sliding plate, and the execution rod penetrates through the execution hole.

8. The electric engine braking device according to claim 1, wherein the execution motor is a linear motor, and a guide frame corresponding to the output end of the execution motor is provided on the sliding plate; and a reset elastic piece is further provided between the sliding plate frame and the contact leaf spring.

* * * * *